US005964232A

United States Patent [19]

Chung

[11] Patent Number: 5,964,232

[45] Date of Patent: Oct. 12, 1999

[54] SPRAYING NOZZLE ASSEMBLY FOR A DISHWASHER

[75] Inventor: Ui-Shik Chung, Seoul, Rep. of Korea

[73] Assignee: Daewoo Electronics Co., Ltd., Seoul, Rep. of Korea

[21] Appl. No.: 08/997,095

[22] Filed: Dec. 23, 1997

[30] Foreign Application Priority Data

Feb. 14, 1997 [KR] Rep. of Korea ..... 97-2248 U

[51] Int. Cl.[6] ..... B08B 3/02

[52] U.S. Cl. ..... 134/176; 134/179; 134/198; 239/244; 239/247; 239/251; 239/263.3

[58] Field of Search ..... 134/176, 179, 134/198; 239/243, 244, 245, 246, 247, 248, 251, 263.3

[56] References Cited

U.S. PATENT DOCUMENTS

| | | | |
|---|---|---|---|
| 2,588,856 | 3/1952 | Raus | 299/64 |
| 4,135,532 | 1/1979 | Rutherford | 134/100 |
| 4,174,723 | 11/1979 | Long | 134/144 |
| 4,175,575 | 11/1979 | Cushing | 134/176 |
| 4,784,168 | 11/1988 | Erminio . | |
| 5,415,350 | 5/1995 | Yoon et al. . | |
| 5,655,556 | 8/1997 | Guerrera et al. . | |
| 5,657,928 | 8/1997 | Jian | 239/242 |

FOREIGN PATENT DOCUMENTS

| | | |
|---|---|---|
| 2 017 486 | 10/1979 | United Kingdom . |
| 2 290 223 | 12/1995 | United Kingdom . |
| 2 314 009 | 12/1997 | United Kingdom . |

*Primary Examiner*—Frankie L. Stinson
*Assistant Examiner*—Mialeeka C. Williams-Bibbs
*Attorney, Agent, or Firm*—Pillsbury Madison & Sutro LLP

[57] ABSTRACT

A spraying nozzle assembly for a dishwasher which can widely spray a washing liquid toward utensils. The spraying nozzle assembly has an adapter fixedly connected to a washing liquid outlet of a pump, a rotary spray arm which is rotatably coupled to an upper portion of the adapter and receives a washing liquid from the pump through the adapter, a spraying nozzle for spraying the washing liquid introduced into the rotary spray arm toward utensils, and a spring assembly which is coupled to the spraying nozzle and allows the spraying nozzle to be moved in such a manner that the direction of the washing liquid being sprayed therefrom is varied. The spring assembly is coupled to a fixing shaft which is eccentrically disposed with respect to a rotating axis of the rotary spraying arm. The spraying nozzle assembly can spread the spraying range of the washing liquid being sprayed, so the utensils can be effectively washed and wasting of the washing liquid can be reduced.

14 Claims, 6 Drawing Sheets

SPRAYING NOZZLE ASSEMBLY FOR A DISHWASHER

BACKGROUND OF THE INVENTION

1. Field of the Invention

The present invention relates to a dishwasher, and more particularly to a spraying nozzle assembly for a dishwasher which can widely spray a washing liquid toward utensils.

2. Description of the Prior Art

A dishwasher is generally used to promptly wash utensils such as glasses, cups, dishes, and bowls or the like which are used in eating and/or drinking places. The dishwasher includes a reservoir in which washing liquid is stored, a washing chamber in which a basket for receiving utensils is installed, and a spraying nozzle assembly for dispersing the washing liquid to the utensils. The spraying nozzle assembly has a plurality of nozzles for spraying the washing liquid or detergent.

FIG. 4 shows a conventional dishwasher 200. As shown in FIG. 4, dishwasher 200 comprises a housing 210, a basket 250 into which utensils 212 are placed, an inner wall 260 forming a washing chamber 262 in which utensils 212 are washed, a bottom wall 220 which is connected to a lower portion of inner wall 260 and on which basket 250 is placed, a door 230 for opening/closing the washing chamber 262, and a pump 240 for circulating the washing liquid toward washing utensils 212.

A spraying nozzle assembly 100 for spraying the washing liquid is installed between bottom wall 220 and basket 250 and is connected to pump 240. Spraying nozzle assembly 100 is provided at its upper surface with a plurality of nozzles 112 for spraying the washing liquid toward utensils 212.

Pump 240 has a washing liquid inlet 241 communicated with a washing liquid tank 242 which is disposed below washing chamber 262 and a washing liquid outlet 244 connected to spraying nozzle assembly 100.

When utensils 212 to be washed are placed in basket 250 provided in washing chamber 262, a predetermined amount of the washing liquid is supplied into washing chamber 262, and then the supplied washing liquid is guided into pump 240 through washing liquid tank 242. While passing through pump 240, the washing liquid is pressurized by pump 240. Then, the pressurized washing liquid is sprayed into washing chamber 262 through washing liquid outlet 244 of pump 240 and nozzles 112 of spraying nozzle assembly 100, thereby washing utensils 212.

However, in conventional dishwasher 200 having the above construction, the washing liquid to be sprayed towards utensils 212 is concentrated at one spot of utensils 212, so a washing effect is reduced.

In order to overcome the above problem, various types of dishwashers have been suggested, but they have presented problems. For example, U.S. Pat. No. 4,784,168 issued to Dall' Oglio Erminio on Nov. 15, 1988 discloses a dishwasher having a rotary spraying nozzle assembly.

FIGS. 5 and 6 show Erminio's dishwasher 10. As shown in FIGS. 5 and 6, Erminio's dishwasher 10 includes a washing chamber 14 into which a basket 12 for receiving utensils is installed, a lid 16 for covering washing chamber 14, a first spray nozzle arm 18 rotatably disposed below basket 12 for spraying a washing liquid, and a second spray nozzle arm 20 which is rotatably mounted on lid 16 and sprays the washing liquid and the detergent.

First and second spray nozzle arms 18 and 20 are connected to a pump (not shown) for supplying the washing water and the detergent, and are provided with a plurality of spray nozzles, respectively. First and second spray nozzle arms 18 and 20 are rotated by the pressure of the washing liquid, which is in the range of 2 and 3 atm, and then spray the washing liquid through the nozzles.

However, as shown in FIG. 6, Erminio's dishwasher 10 cannot distribute the washing liquid to corners CN of washing chamber 14 even though first and second spray nozzle arms 18 and 20 can be rotated, so the washing effect near corners CN of washing chamber 14 is reduced.

SUMMARY OF THE INVENTION

The present invention has been made to overcome the above described problems of the prior arts. Accordingly, it is an object of the present invention to provide a spraying nozzle assembly for a dishwasher which can widely spray a washing liquid towards utensils placed in a washing chamber, thereby improving the washing effect.

To accomplish the above object of the present invention, there is provided a spraying nozzle assembly for a dishwasher, the spraying nozzle assembly comprising:

an adapter fixedly connected to a washing liquid outlet of a pump which is disposed below a washing chamber of the dishwasher, for circulating washing liquid supplied into the washing chamber;

a rotary spray arm which is rotatably coupled to an upper portion of the adapter and is disposed at a lower portion of the washing chamber, the rotary spray arm being coaxially disposed with the adapter, the rotary spray arm having a washing liquid receiving chamber therein into which the washing liquid is introduced from the pump through the adapter;

a first means for spraying the washing liquid introduced into the rotary spray arm toward utensils placed in the washing chamber; and a second means for varying a direction of the washing liquid being sprayed toward the utensils.

According to the preferred embodiment of the present invention, the first means includes a plurality of spraying ports which are formed on an upper surface of the rotary spray arm in accordance with a longitudinal axis thereof. The spraying ports have at least one first spraying port which is disposed at a left side about a transverse axis of the rotary spray arm, and at least one second spraying port which is disposed at a right side about the transverse axis of the rotary spray arm. The second spraying port extends by a predetermined length toward an inner portion of the rotary spray arm. The first means includes at least one spraying nozzle which is movably installed in the second spraying port.

The spraying nozzle includes a spherical head portion installed in the second spraying port, a cylindrical extension portion which is integrally formed at a lower portion of the spherical head portion, and a link portion which is integrally formed with a free end of the cylindrical extension portion. The spraying nozzle has a liquid passage therein for spraying the washing liquid.

The second means includes a spring assembly which is compressed or expanded as the rotary spray arm is being rotated, thereby moving the spraying nozzle in a forward direction or a backward direction, and a third means for compressing and expanding the spring assembly in accordance with a rotation of the rotary spray arm. The spring assembly is disposed in the washing liquid receiving chamber of the rotary spray arm and is coupled to the link of the spraying nozzle.

The third means includes an elongated plate fixedly inserted in the adapter, a fixing shaft which is integrally formed on an upper surface of the elongated plate and upwardly extends therefrom, a seat portion formed at an upper portion of the fixing shaft, a metal ring rotatably inserted around the fixing shaft and rested on the seat portion, and a cap member screw-coupled into an upper portion of the fixing shaft for preventing the metal ring from separating from the fixing shaft. The fixing shaft is eccentrically disposed with respect to a rotating axis of the rotary spray arm. The metal ring is connected to the spring assembly.

The spring assembly includes a tension spring, a hook bar which is integrally formed with a first end of the tension spring and is fixedly coupled to the metal ring, and a screw bar which is integrally formed with a second end of the tension spring and extends beyond the rotary spray arm by passing through a front wall of the rotary spray arm.

When utensils to be washed are placed in a basket provided in a washing chamber, a predetermined amount of the washing liquid is supplied into the washing chamber. The supplied washing liquid is guided into a pump. While passing through the pump, the washing liquid is pressurized by the pump, and then, the pressurized washing liquid is introduced into the washing liquid receiving chamber. At this time, the rotary spray arm is rotated in a predetermined direction caused by a repelling power which is applied to rotary spray arm when the washing liquid is discharged through liquid discharging holes formed at both sides thereof.

At the same time, the pressurized washing liquid is sprayed into the utensils placed in the basket through the first spraying port and the spraying nozzle.

When the rotary spray arm rotates, since the fixing shaft is eccentrically disposed with respect to the rotating axis of the rotary spray arm, the tension spring is compressed due to its restoring force.

When the tension spring is compressed, the link coupled to the upper portion of the tension spring moves by a predetermined distance towards the fixing shaft, so the head portion of the spraying nozzle pivots about the link. As a result, the direction of the washing liquid being sprayed through the liquid passage varies.

Such a rotation of the rotary spray arm is continuously carried out while the washing operation is being executed, so the washing liquid not only vertically sprays onto the utensils through the first spraying port, but also sprays onto the utensils at various spraying angles through the spraying nozzle.

As described above, the spraying nozzle assembly according to the present invention can spread the spraying range of the washing liquid being sprayed, so the utensils can be effectively washed and wasting of the washing liquid can be reduced.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Hereinafter, the preferred embodiment of the present invention will be explained in more detail with reference to the accompanying drawings.

Figure 1:
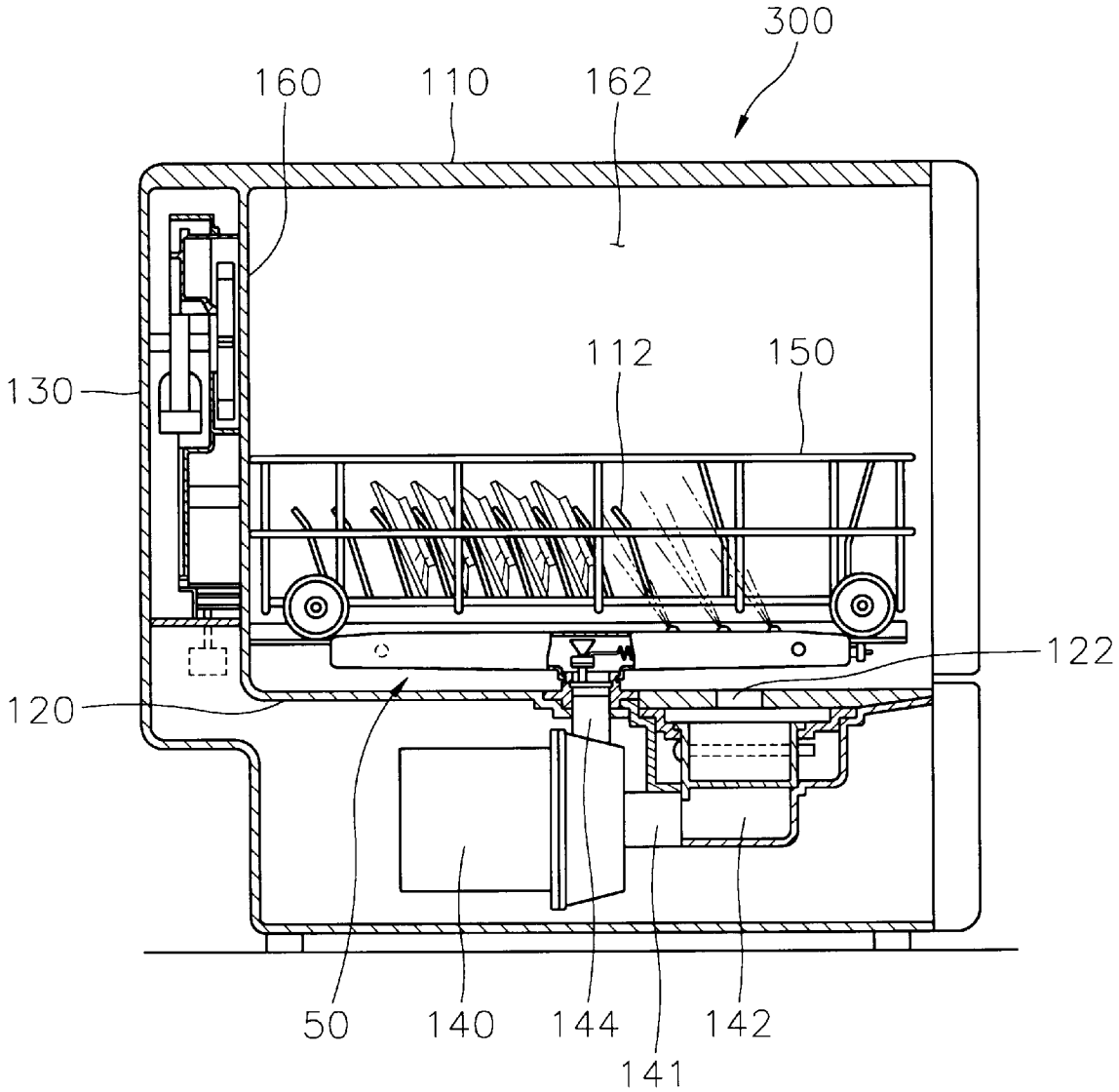
FIG. 1 is a sectional view of a dishwasher having a spraying nozzle assembly according to one embodiment of the present invention.

FIG. 1 shows a dishwasher 300 having a spraying nozzle assembly according to the preferred embodiment of the present invention. As shown in FIG. 1, dishwasher 300 comprises a housing 110, a basket 150 into which utensils 112 are placed, an inner wall 160 forming a washing chamber 162 in which utensils 112 are washed, a bottom wall 120 which is connected to a lower portion of inner wall 160 and on which basket 150 is placed, a door 130 for opening/closing the washing chamber 162, and a pump 140 disposed below washing chamber 162 for circulating the washing liquid toward washing utensils 112.

A spraying nozzle assembly 50 according to the present invention is installed between bottom wall 120 and basket 150 and is connected to pump 140. Spraying nozzle assembly 50 will be further described below with reference to FIGS. 2, 2A, and 3.

Pump 140 has a washing liquid inlet 141 communicated with a washing liquid tank 142 which is disposed below washing chamber 162 and a washing liquid outlet 144 connected to spraying nozzle assembly 50. In addition, a discharge hole 122 for allowing the washing liquid to flow from washing chamber 162 to washing liquid tank 142 is formed at bottom plate 120.

Hereinafter, spraying nozzle assembly 50 will be detailedly explained.

Figure 2:
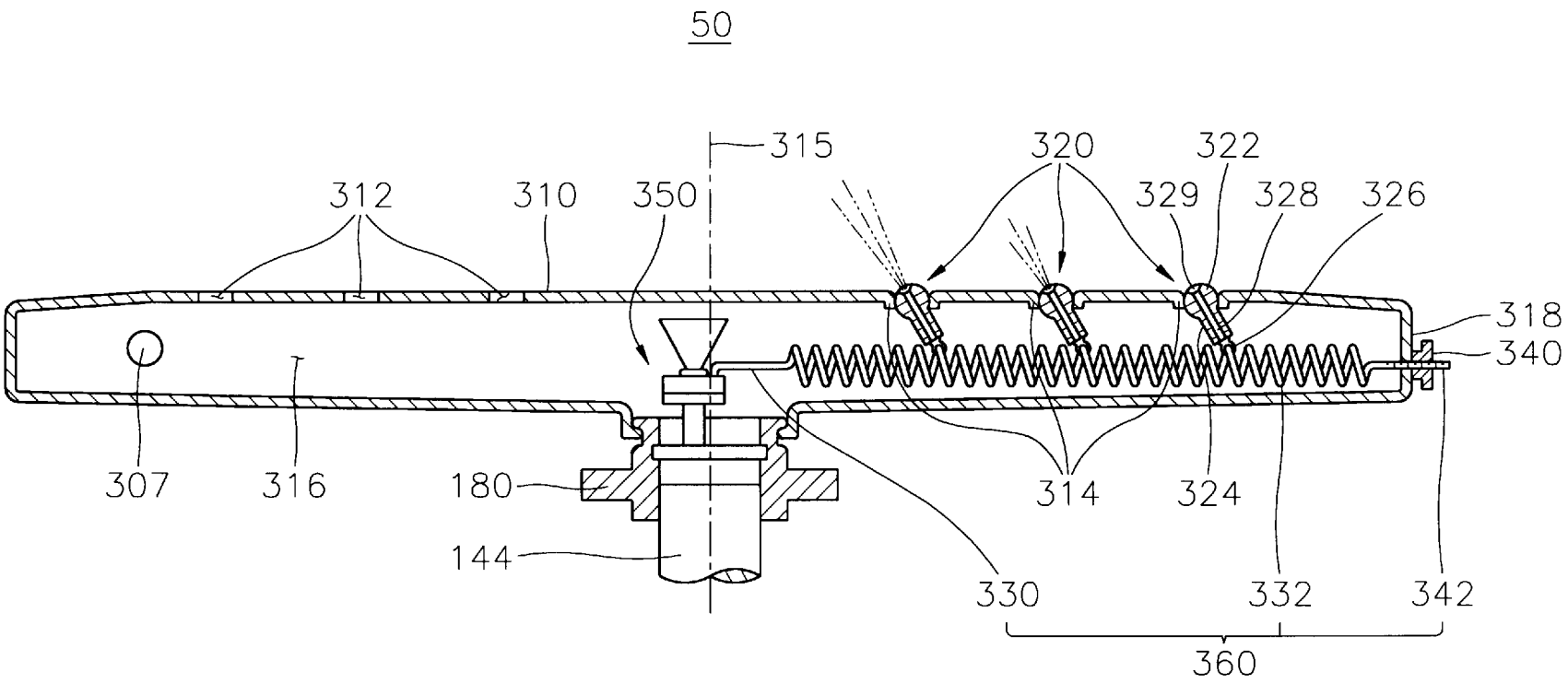
FIG. 2 is a sectional view showing the structure of the spraying nozzle assembly shown in FIG. 1.

As shown in FIG. 2, spraying nozzle assembly 50 comprises an adapter 180 fixedly connected to washing liquid outlet 144 of pump 140 and a rotary spray arm 310 which is rotatably coupled to an upper portion of adapter 180, and is disposed at a lower portion of washing chamber 162. Rotary spray arm 310 is coaxially disposed with adapter 180 and has a washing liquid receiving chamber 316 therein into which the washing liquid is introduced from pump 140 through adapter 180. A plurality of spraying ports are formed on an upper surface of rotary spray arm 310.

The spraying ports include at least one first spraying port 312 which is disposed at a left side about a transverse axis 315 of rotary spray arm 310, and at least one second spraying port 314 which is disposed at a right side about transverse axis 315 of rotary spray arm 310. Second spraying port 314 extends by a predetermined length toward an inner portion of rotary spray arm 310.

Figure 3:
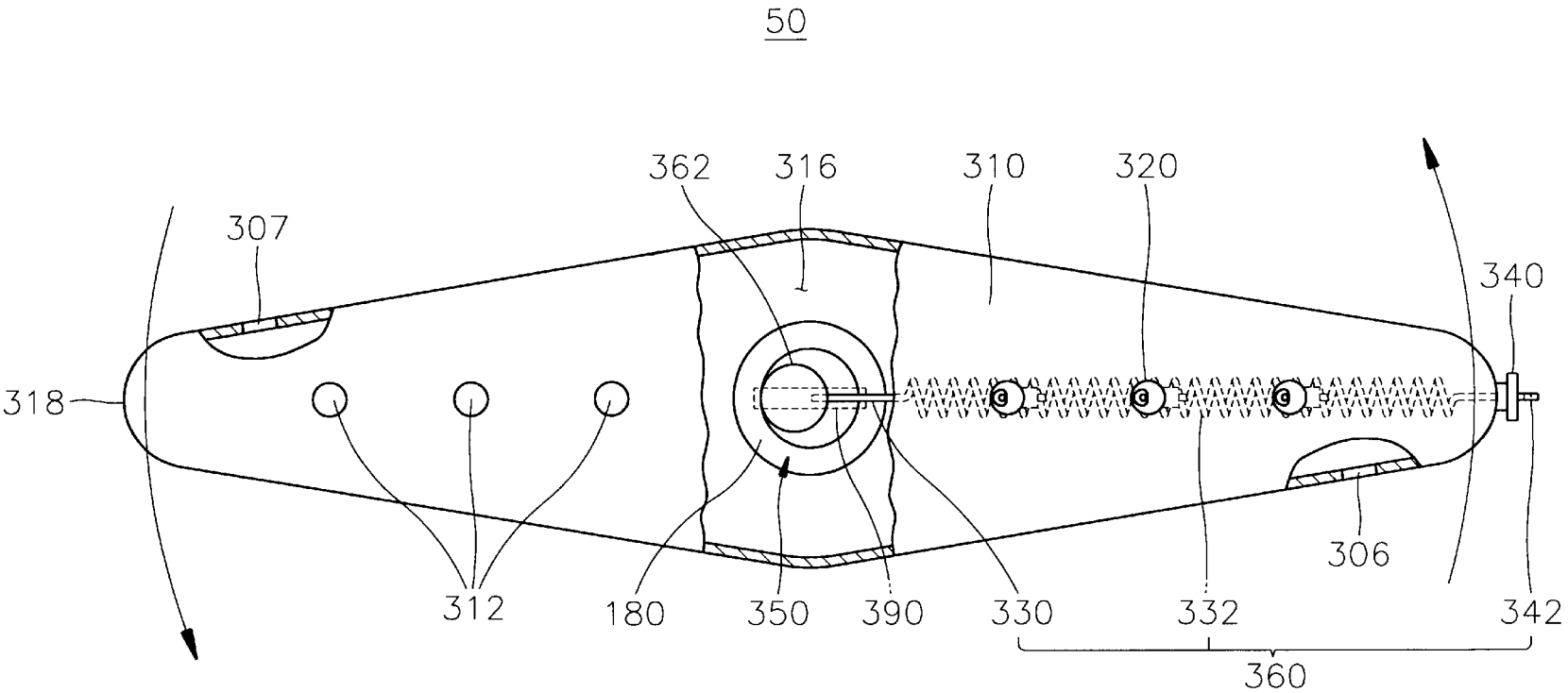
FIG. 3 is a partially sectional plan view of the spraying nozzle assembly shown in FIG. 2.
Figure 4:
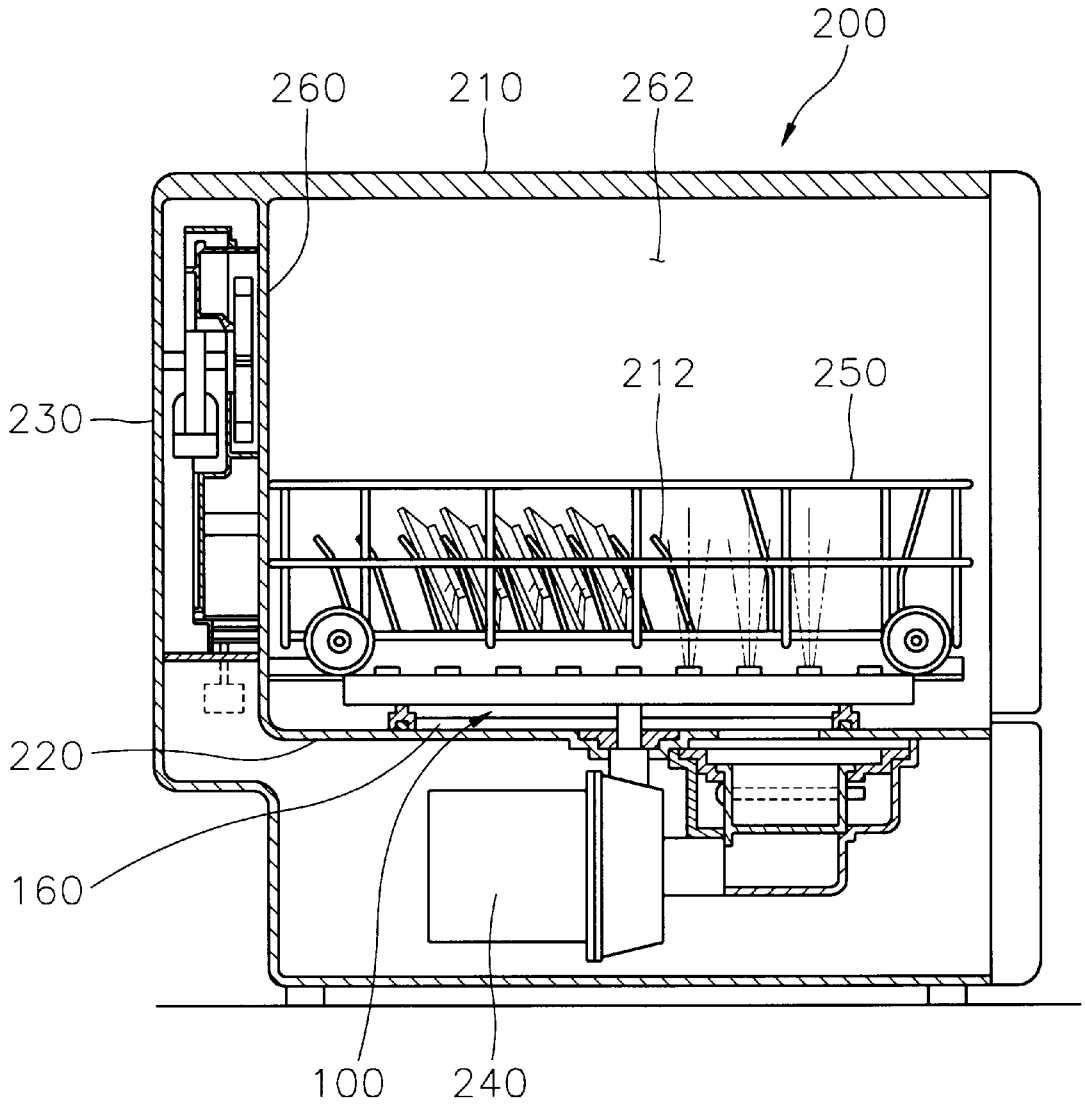
FIG. 4 is a sectional view of a conventional dishwasher.
Figure 5:
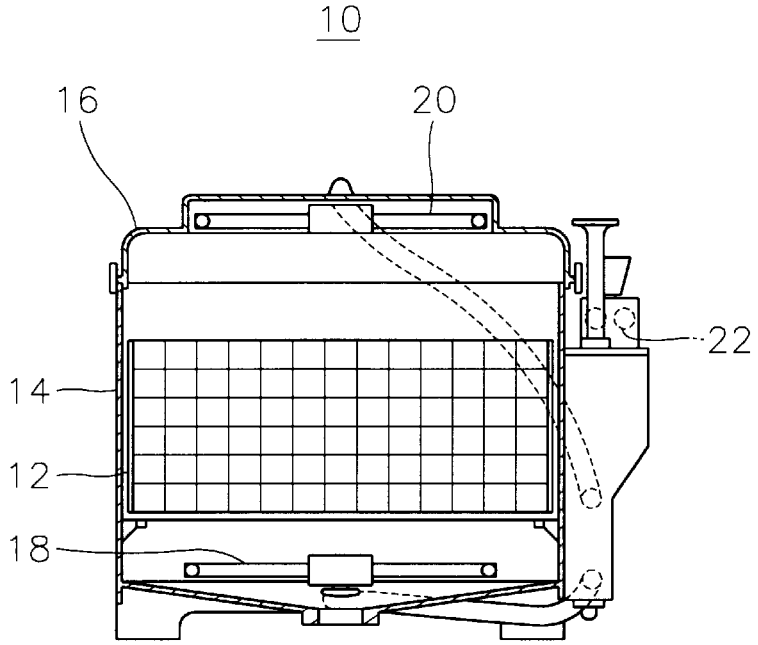
FIG. 5 (PRIOR ART)
FIG. 5 is a sectional view of another conventional dishwasher.
Figure 6:
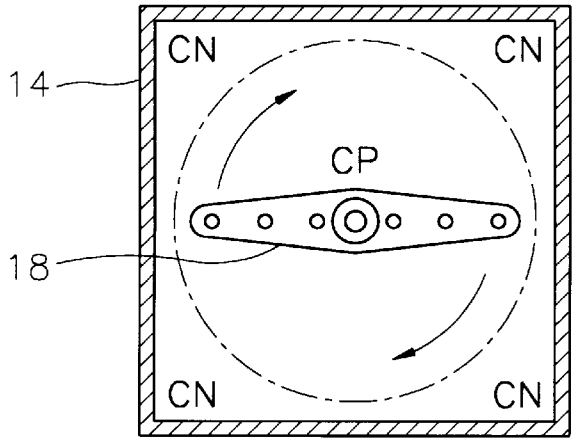
FIG. 6 (PRIOR ART)
FIG. 6 is a sectional plan view showing a rotating direction of a spraying nozzle assembly shown in FIG. 5.

As shown in FIG. 3, first and second spraying ports 312 and 314 are disposed in line with each other along a longitudinal axis of rotary spray arm 310. In addition, rotary spray arm 310 is formed at a front end of a first side thereof with a first washing liquid discharging hole 306, and is formed at a rear end of a second side thereof with a second washing liquid discharging hole 307. Rotary spray arm 310 is rotated in a predetermined direction caused by a repelling power which is applied to rotary spray arm 310 when the washing liquid is discharged through first and second washing liquid discharging holes 306, and 307.

Referring again to FIG. 2, at least one spraying nozzle 320 is movably installed in second spraying port 320. According to the preferred embodiment of the present invention, three spraying nozzles 320 are movably installed in three second spraying ports 314, respectively.

Each spraying nozzle 320 includes a spherical head portion 322 installed in second spraying port 314, a cylindrical extension portion 324 which is integrally formed at a lower portion of spherical head portion 322, and a link portion 326 which is integrally formed with a free end of cylindrical extension portion 324. In addition, spraying nozzle 320 has a liquid passage 328 therein for spraying the washing liquid. Liquid passage 328 is formed at an upper portion thereof with a chamfered portion 329 for spreading a spraying range of the washing liquid. Preferably, chamfered portion 329 is inclined at an angle of 45 degrees.

In order to prevent spraying nozzle 320 from dropping into washing liquid receiving chamber 316 of rotary spray arm 310, spherical head portion 322 has a first diameter larger than a second diameter of second spraying port 314.

In washing liquid receiving chamber 316, there are provided a spring assembly 360 which is compressed or expanded as rotary spray arm 310 is being rotated, thereby moving spraying nozzle 320 in a forward direction or a backward direction, and a supporting member 350 for compressing and expanding spring assembly 360 in accordance with a rotation of rotary spray arm 310. Spring assembly 360 is coupled to link 326 of spraying nozzle 320.

Figure 2A:
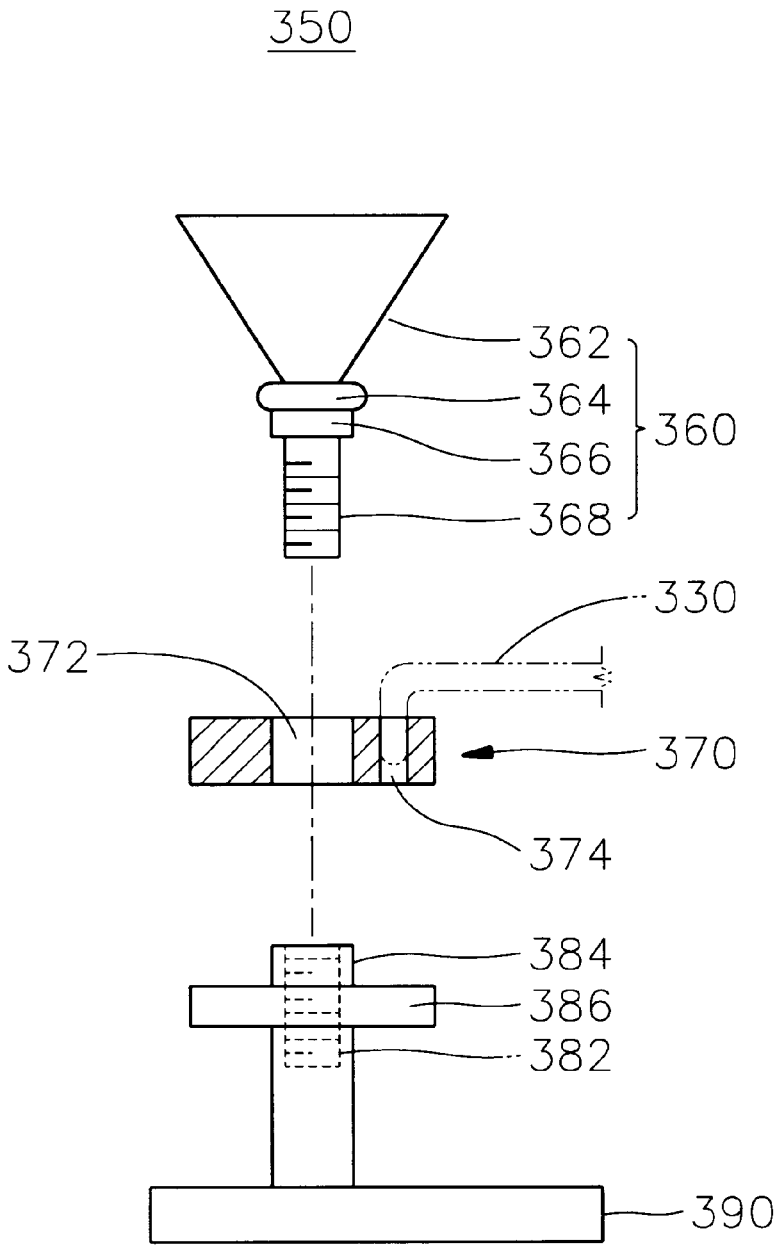
FIG. 2A is an exploded view showing a supporting member shown in FIG. 1.

FIG. 2A shows an exploded view of supporting member 350. As shown in FIG. 2A, supporting member 350 includes an elongated plate 390 fixedly inserted in adapter 180, a fixing shaft 384 integrally formed on an upper surface of elongated plate 350 and upwardly extending therefrom, a seat portion 386 formed at an upper portion of fixing shaft 384, a metal ring 370 rotatably inserted around fixing shaft 384 and rested on seat portion 386, and a cap member 360 screw-coupled into an upper portion of fixing shaft 384, for preventing metal ring 370 from separating from fixing shaft 384.

Metal ring 370 has a center hole 372 at a center thereof and a fixing hole 374 which is spaced by a predetermined distance apart from center hole 374.

Cap member 360 includes a frusto-conical head portion 362, a loop portion 364 provided at an underside of frusto-conical head portion 365, a neck portion 366 provided at an underside of loop portion 364, and a screw portion 368 provided at an underside of neck portion 366 so as to be coupled into a screw hole 382 formed on an upper surface of fixing shaft 384. The above elements are integrally formed with each other.

In order to prevent metal ring 370 from separating from fixing shaft 384, loop portion 364 has a first diameter larger than a second diameter of center hole 372 of metal ring 370. Preferably, neck portion 366 has a third diameter which is identical to a fourth diameter of fixing shaft 384.

As shown in FIG. 3, elongated plate 390 has a rectangular shape and fixing shaft 384 is eccentrically disposed with respect to a rotating axis of rotary spray arm 310.

Referring again to FIG. 2, spring assembly 360 includes a tension spring 332, and link 324 of spraying nozzle 320 is coupled to an upper portion of tension spring 360. A hook bar 330 is integrally formed with a first end of tension spring 332 and is fixedly coupled to metal ring 370. A screw bar 342 is integrally formed with a second end of tension spring 332 and extends beyond rotary spray arm 310 by passing through a front wall 318 of rotary spray arm 310. Screw bar 342 is screw-coupled with an adjusting nut 340, so a user can adjust a tension of tension spring 332 by rotating adjusting nut 340.

Spraying nozzle assembly 50 having the above structure operates as follows.

When utensils 112 to be washed are placed in basket 150 provided in washing chamber 162, a predetermined amount of the washing liquid is supplied into washing chamber 162 by a liquid supplying device (not shown). The supplied washing liquid is guided into pump 140 through discharging hole 122 formed at bottom plate 120, washing liquid tank 142 provided below washing chamber 162, and washing liquid inlet 141 of pump 140. While passing through pump 140, the washing liquid is pressurized by pump 140. Then, the pressurized washing liquid is introduced into washing liquid receiving chamber 316 through washing liquid outlet 144 of pump 140 and through adapter 180 connected to washing liquid outlet 144.

Then, the pressurized washing liquid is discharged into washing chamber 162 through first and second washing liquid discharging holes 306 and 307. At this time, rotary spray arm 310 is rotated in a predetermined direction caused by a repelling power which is applied to rotary spray arm 310 when the washing liquid is discharged through first and second washing liquid discharging holes 306 and 307.

At the same time, the pressurized washing liquid is sprayed into utensils 112 placed in basket 150 through first spraying port 312 and spraying nozzle 320 which are formed on the upper surface of rotary spray arm 310.

FIG. 3 shows tension spring 332 when tension spring 332 is in its maximum expanded position. When rotary spray arm 310 rotates from the position shown in FIG. 3, since fixing shaft 384 is eccentrically disposed with respect to the rotating axis of rotary spray arm 310, the distance between front wall 319 of rotary spray arm 310 and fixing shaft 384 becomes shorter than the distance shown in FIG. 3, so tension spring 332 is compressed due to its restoring force.

When tension spring 332 is compressed, link 326 coupled to the upper portion of tension spring 332 moves by a predetermined distance towards fixing shaft 384, so head portion 322 of spraying nozzle 320 pivots about link 326. As a result, the direction of the washing liquid being sprayed through liquid passage 328 varies.

When rotary spray arm 310 rotates by an angle of 180 degrees from the position shown in FIG. 3, tension spring 332 becomes its maximum compressed state so that head portion 322 of spraying nozzle 320 is positioned in the opposite direction from the position shown in FIG. 3.

Such a rotation of rotary spray arm 310 is continuously carried out while the washing operation is being executed, so the washing liquid not only vertically sprays onto utensils 112 through first spraying port 312, but also sprays onto utensils 112 at various spraying angles through spraying nozzle 320.

As described above, the spraying nozzle assembly according to the present invention can spread the spraying range of the washing liquid being sprayed, so the utensils can be effectively washed and wasting of the washing liquid can be reduced.

Although the preferred embodiment of the invention has been described, it is understood that the present invention should not be limited to the preferred embodiment, but various changes and modifications can be made by one skilled in the art within the spirit and scope of the invention as hereinafter claimed.

What is claimed is:

1. A spraying nozzle assembly for a dishwasher, the spraying nozzle assembly comprising:

an adapter fixedly connected to a washing liquid outlet of a pump which is disposed below a washing chamber of the dishwasher, for circulating washing liquid supplied into the washing chamber;

a rotary spray arm which is rotatably coupled to an upper portion of the adapter and is disposed at a lower portion of the washing chamber, the rotary spray arm being coaxially disposed with the adapter, the rotary spray arm having a washing liquid receiving chamber therein into which the washing liquid is introduced from the pump through the adapter;

a first means for spraying the washing liquid introduced into the rotary spray arm toward utensils placed in the washing chamber, the first means including a plurality of spraying ports which are formed on an upper surface of the rotary spray arm in accordance with a longitudinal axis thereof, the spraying ports having at least one first spraying port which is disposed at a left side about a transverse axis of the rotary spray arm, and at least one second spraying port which is disposed at a right side about the transverse axis of the rotary spray arm, the second spraying port extending by a predetermined length toward an inner portion of the rotary spray arm, the first means including at least one spraying nozzle which is movably installed in the second spraying port; and a second means for varying a direction of the washing liquid being sprayed toward the utensils, the second means including a spring assembly which is compressed or expanded as the rotary spray arm is being rotated, thereby moving the spraying nozzle in a forward direction or a backward direction, and a third means for compressing and expanding the spring assembly in accordance with a rotation of the rotary spray arm, the spring assembly being disposed in the washing liquid receiving chamber of the rotary spray arm and being coupled to the spraying nozzle.

2. The spraying nozzle assembly as claimed in claim 1, wherein the rotary spray arm is formed at a front end of a first side thereof with a first washing liquid discharging hole, and is formed at a rear end of a second side thereof with a second washing liquid discharging hole, the first side being opposite to the second side, the rotary spray arm being rotated in a predetermined direction caused by a repelling power which is applied to the rotary spray arm when the washing liquid is discharged through the first and second washing liquid discharging holes.

3. The spraying nozzle assembly as claimed in claim 1, wherein the first means includes three second spraying ports and three spraying nozzles which are movably installed in the three second spraying ports, respectively.

4. The spraying nozzle assembly as claimed in claim 1, wherein the spraying nozzle includes a spherical head portion installed in the second spraying port, a cylindrical extension portion which is integrally formed at a lower portion of the spherical head portion, and a link portion which is integrally formed with a free end of the cylindrical extension portion and to which the spring assembly is coupled, the spraying nozzle having a liquid passage therein for spraying the washing liquid.

5. The spraying nozzle assembly as claimed in claim 4, wherein the spherical head portion has a first diameter larger than a second diameter of the second spraying port.

6. The spraying nozzle assembly as claimed in claim 4, wherein the liquid passage is formed at an upper portion thereof with a chamfered portion for spreading a spraying range of the washing liquid.

7. The spraying nozzle assembly as claimed in claim 4, wherein the third means includes an elongated plate fixedly inserted in the adapter, a fixing shaft which is integrally formed on an upper surface of the elongated plate and upwardly extends therefrom, a seat portion formed at an upper portion of the fixing shaft, a metal ring rotatably inserted around the fixing shaft and rested on the seat portion, and a cap member screw-coupled into an upper portion of the fixing shaft for preventing the metal ring from separating from the fixing shaft, the fixing shaft being eccentrically disposed with respect to a rotating axis of the rotary spray arm, the metal ring being connected to the spring assembly.

8. The spraying nozzle assembly as claimed in claim 7, wherein the cap member includes a frusto-conical head portion, a loop portion provided at an underside of the frusto-conical head portion, a neck portion provided at an underside of the loop portion, and a screw portion provided at an underside of the neck portion so as to be coupled into a screw hole formed on an upper surface of the fixing shaft.

9. The spraying nozzle assembly as claimed in claim 8, wherein the spring assembly includes a tension spring, a hook bar which is integrally formed with a first end of the tension spring and is fixedly coupled to the metal ring, and a screw bar which is integrally formed with a second end of the tension spring and extends beyond the rotary spray arm by passing through a front wall of the rotary spray arm.

10. The spraying nozzle assembly as claimed in claim 9, wherein the link portion of the spraying nozzle is coupled to an upper portion of the tension spring.

11. The spraying nozzle assembly as claimed in claim 9, wherein the metal ring has a center hole at a center thereof and a fixing hole which is spaced by a predetermined distance apart from the center hole, the hook bar being fixedly inserted into the fixing hole.

12. The spraying nozzle assembly as claimed in claim 11, wherein the loop portion has a first diameter larger than a second diameter of the center hole of the metal ring.

13. The spraying nozzle assembly as claimed in claim 11, wherein the neck portion has a first diameter identical to a second diameter of the fixing shaft, and the elongated plate has a rectangular shape.

14. The spraying nozzle assembly as claimed in claim 9, further comprising a adjusting nut which is screw-coupled with the screw bar, for adjusting a tension of the tension spring.

* * * * *